United States Patent [19]

Laurie et al.

[11] 4,006,678

[45] Feb. 8, 1977

[54] MACHINE FOR COMPRESSING, SLITTING AND BALING STACKS OF TIRES

[76] Inventors: Albert F. Laurie, 7239 N. Chase, Portland, Oreg. 97217; G. W. Bunch, 11775 SW. Warner, Tigard, Oreg. 97223

[22] Filed: Sept. 18, 1975

[21] Appl. No.: 614,550

[52] U.S. Cl. ..... 100/1; 100/3; 100/6; 100/98 R; 100/218; 83/140; 206/304

[51] Int. Cl.² ..... B65B 13/20

[58] Field of Search ..... 83/140; 206/303, 304; 100/3, 6, 39, 98 R, 218, 12, 295, 269 R, 1

[56] References Cited

UNITED STATES PATENTS

| | | | |
|---|---|---|---|
| 1,507,376 | 9/1924 | Hintz | 100/12 X |
| 2,677,324 | 5/1954 | Cadella | 100/98 |
| 2,884,694 | 5/1959 | Hannon | 100/98 R X |
| 2,921,423 | 1/1960 | Cover | 100/12 UX |
| 3,203,343 | 8/1965 | Myers | 100/98 R |
| 3,269,301 | 8/1966 | Krause | 100/98 X |
| 3,352,228 | 11/1967 | Hill | 100/12 |
| 3,379,123 | 4/1968 | Weltner | 100/98 |
| 3,613,567 | 10/1971 | Loughran | 100/269 R X |
| 3,675,569 | 7/1972 | Moor | 100/12 X |
| 3,682,092 | 8/1972 | Breton et al. | 100/269 R X |
| 3,772,983 | 11/1973 | Nichols | 100/295 X |

*Primary Examiner*—Billy J. Wilhite

[57] ABSTRACT

A machine with an open upstanding frame has a central space within which a stack of tires are placed. A hydraulic ram mounted on top of the frame, when retracted, supports a press platen slidable on vertical frame posts above the stack and a knife platen spaced above the press platen. Four tire-slitting knives project downwardly from the knife platen in alignment with slots in the press platen. When the ram extends, the knife and press platens move downwardly until the press platen engages the stack. Thereafter continued extension of the ram causes compression springs between the platens to contract so that the knife platen continues downwardly until it engages the press platen and the knives pass through the slots of the press platen into cutting engagement with the stack. Thereafter the knife and press platens continue downwardly together simultaneously compressing and slitting the stack. When the stack is fully compressed and slit through, aligned radial slots in the press platen, in a stationary base plate supporting the stack and in a centering spool on the base plate enable tying of the compressed stack into a bale. Upon retraction of the ram, a knife-stripping mechanism enables withdrawal of the slitting knives from the bale before retraction of the press platen.

15 Claims, 8 Drawing Figures

FIG. 2
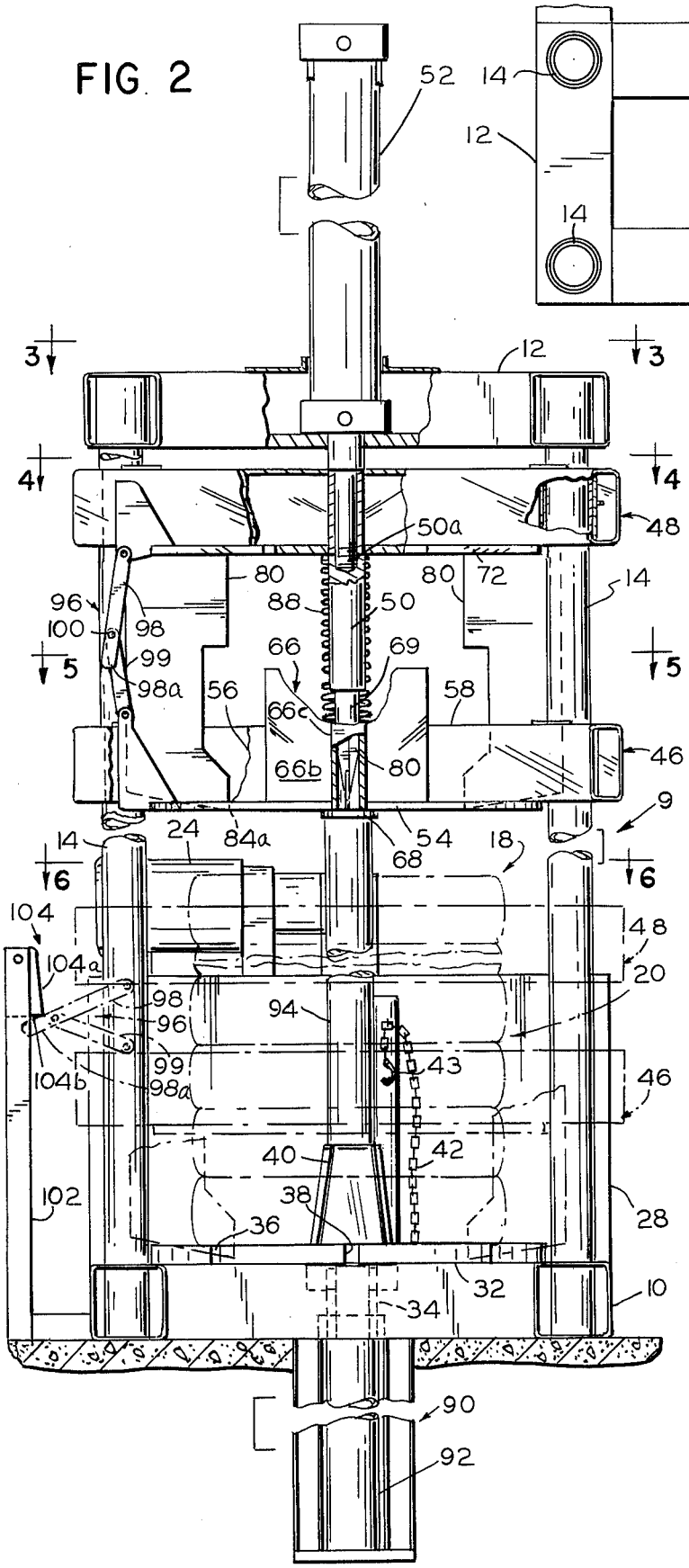
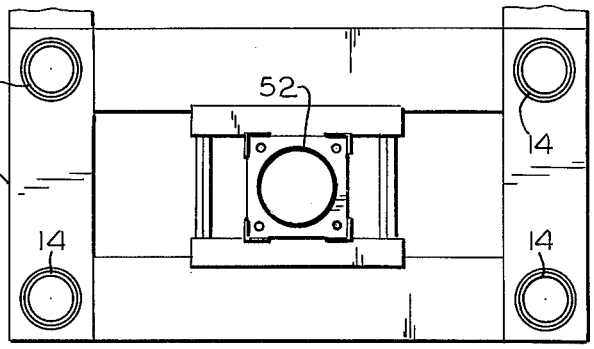
FIG. 3
FIG. 8
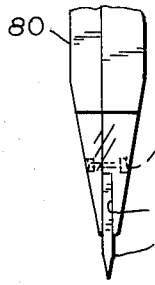
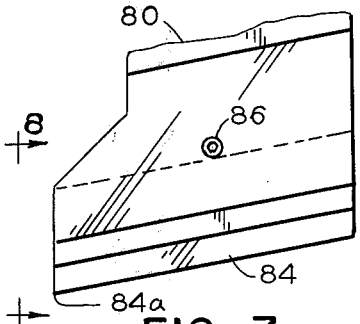
FIG. 7

MACHINE FOR COMPRESSING, SLITTING AND BALING STACKS OF TIRES

BACKGROUND OF THE INVENTION

1. Field of the Invention

The present invention relates to a machine for compressing, slitting and baling a stack of rubber tires.

2. Description of the Prior Art

Used rubber tires have created a serious disposal problem. They cannot readily be buried as landfill because of their bulkiness. When burned they produce dense black smoke which creates an air pollution problem. It has been proposed that they be chopped into small pieces and either burned in incinerators or used as landfill. However, machines designed for this purpose have not had the capacity to handle the large volumes of discarded tires that exist.

It has also been proposed that stacks of such tires be compressed and tied into small bales and then buried as landfill. Machines for this purpose have been in use and are manufactured by Metaltronics, Inc., of Portland, Oregon. Such machines are characterized by a single press platen slidable on vertically extending posts and operated by a hydraulic ram to compress a stack of tires into a small bale. While compressed by the single platen, the stack is tied before the platen is withdrawn.

Tire bales as described have been found to be desirable for use as fish habitats as described more fully in applicants' prior copending application Ser. No. 574,595, filed May 5, 1975. However, such bales tend to float and drift in water because of their buoyancy caused by the air which the tire carcasses entrap. Such bales also tend to pollute bodies of water because of the polluted water which the tire carcasses often contain. To counteract the tendency of the bales to drift, they have been filled with a ballast such as concrete. However, this is expensive and time-consuming and therefore impractical. It has also been suggested that holes be drilled, punched, cut or sawn through the bales to permit the escape of the trapped air and water. However, prior means for accomplishing this have proved unsatisfactory because they have required an operation separate from the compressing and baling operation and additional machines or tools, thereby increasing appreciably the cost of producing the bales. Also it has been found that rubber tires cannot be readily sawn, and that punched or drilled holes are usually not large enough in size or number to serve the purpose.

SUMMARY OF THE INVENTION

To meet the demand for compressed nonbuoyant tire bales, applicants have devised a machine for simultaneously compressing and slitting a stack of tires with knives and for facilitating tying of the compressed stack into a bale while under compression in the machine.

The machine of the invention utilizes a so-called "double platen" concept in which a pressure-applying means is operatively connected to a knife platen which is initially in a retracted position above the tire stack. The knife platen carries a series of downwardly projecting slitting knives positioned for forming the desired slits through the underlying stack. Spaced below the knife platen and above the stack is a second, press platen. The knives of the knife platen are aligned with openings through the press platen. In the retracted positions of the two platens, the knives do not project substantially below the press platen. However, upon operation of the pressure-applying means, the knife platen approaches the press platen, causing the knives to pass through the press platen and into cutting engagement with the stack. When the knife platen thereafter contacts the press platen, the two platens move downwardly together to compress and slit the stack vertically. The knives thus form radial slits at positions about the periphery of the bale which, because of the nature of the tires, open up into large vee-shaped openings which readily permit entrapped air and water to escape from tire carcasses while they are compressed.

A primary object of the invention is to provide a machine for compressing and slitting a stack of rubber tires and for facilitating the baling of the compressed stack.

Another primary object of the invention is to provide a machine for simultaneously compressing and slitting a stack of rubber tires.

Another principal object is to provide a machine as aforesaid for producing peripheral slits in a tire bale which pass completely through the length of the bale and extend from the periphery of the bale radially inwardly but stopping short of the tire beads so as to maintain the integrity of the bale.

Another important object is to provide a machine for compressing and slitting a stack of tires as aforesaid which enables tying of the bale while it remains compressed in the machine.

Another important object is to provide a machine as aforesaid with means for stripping the knives from the bale upon retraction of the knife and press platens to their uppermost positions.

Further objects are to provide a machine as aforesaid that is fast, inexpensive and easy to operate and maintain and one that requires little maintenance and only one person to operate.

The foregoing and other objects, features and advantages of the present invention will become more apparent from the following detailed description which proceeds with reference to the accompanying drawings.

BRIEF DESCRIPTION OF THE DRAWINGS

In the drawings:

FIG. 2 is a foreshortened elevational view of the machine of FIG. 1 on an enlarged scale;

FIG. 3 is a horizontal sectional view taken along the line 3—3 of FIG. 2;

FIG. 7 is a side view of the lower cutting portion of one of the knives shown in FIG. 2; and FIG. 8 is a front view of the lower cutting portion of the knife of FIG. 7.

DETAILED DESCRIPTION

Figure 6:
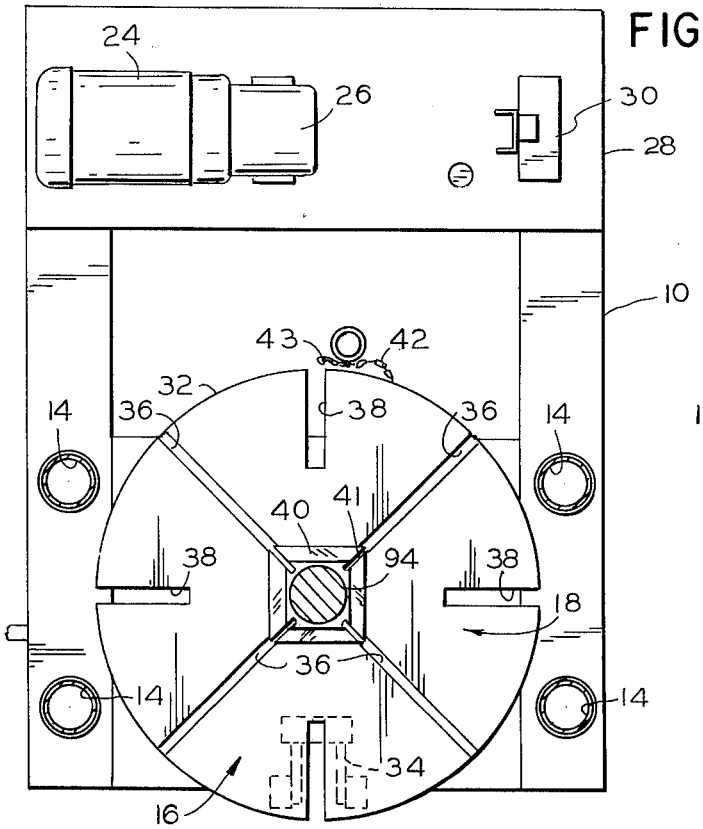
FIG. 6 is a horizontal sectional view taken along the line 6—6 of FIG. 2.
Figure 1:
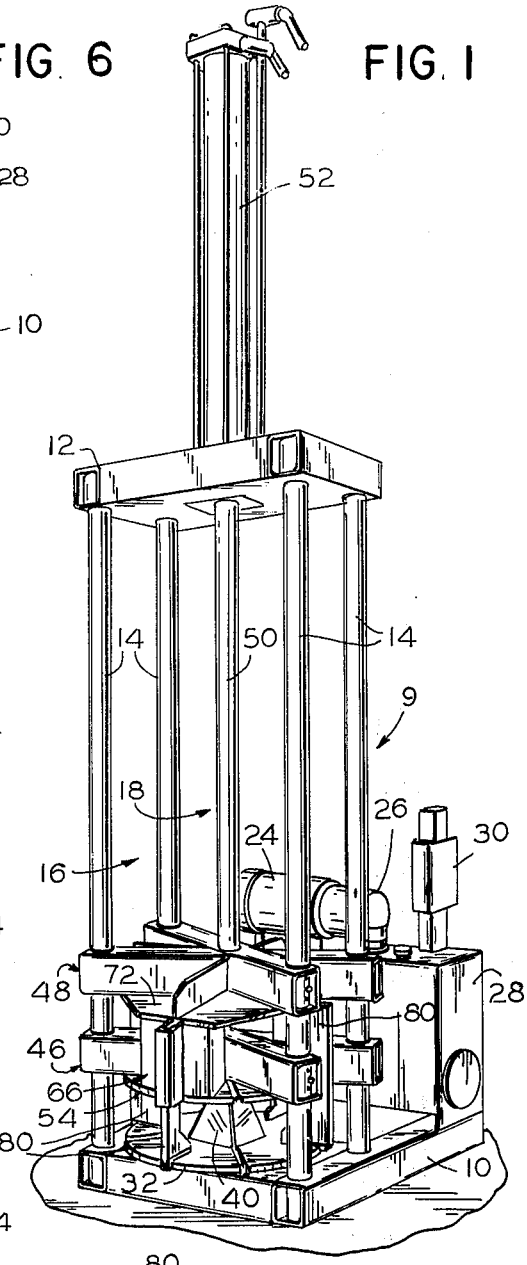
FIG. 1 is a perspective view of a machine in accordance with the invention.

Referring first to FIGS. 1 and 2 of the drawings, a preferred embodiment of the machine of the invention includes an open upstanding frame structure 9 with a stationary base frame 10 spaced below a stationary top frame 12 supported by four vertical cylindrical slide frame posts 14. The posts are positioned along opposite sides of the frame to provide a front access opening at 16, shown in FIG. 6, for access to a vertically extending stacking space 18 within the frame structure for receiving a stack of tires 20. Base frame 10 includes a rear portion behind posts 14 which supports the power system and controls for the machine including a motor 24, for driving a hydraulic pump 26 and a hydraulic tank 28. The necessary controls for operating the machine are housed in a control box 30 at one end of the tank.

Frame base 10 mounts a stationary circular base plate 32 hinged at 34 to a front of the base frame for enabling upward tilting of the base plate upon completion of the baling operation to dump a completed bale forwardly from the machine. A lifting chain 42 having a hook 43 at its free end is connected to an edge of base plate 32 opposite hinge 34 for use in lifting the plate about its hinge. Base plate 32 also includes four equally spaced long radial slots 36 which provide guideways for the passage of a strap or wire to encircle a compressed stack in a manner to be described. The periphery of plate 32 also has equally spaced short radial knife slots 38 between long slots 36. The short slots are aligned to receive the lower cutting edges of tire-slitting knives of the machine to enable the knives to cut completely through the stack. Centered on base plate 32 is a generally pyramidal tire-centering spool 40 provided with surface slots 41 in radial alignment with long slots 36 of the base plate. Spool slots 41 cooperate with slots 36 of the base plate in guiding a baling wire or strap down through the center opening of a compressed stack.

Two platen means including a first, press platen means 46 and a second, knife platen means 48 are mounted for sliding movement on the four slide frame posts 14. These platens extend across stacking space 18 in vertical alignment with base plate 32. They are supported in retracted upper limit positions, shown in full lines in FIG. 2, above a stack 20 by a downwardly extensible ram portion 50 of a long stroke hydraulic ram 52 mounted vertically in a central position on top frame 12.

Figure 5:
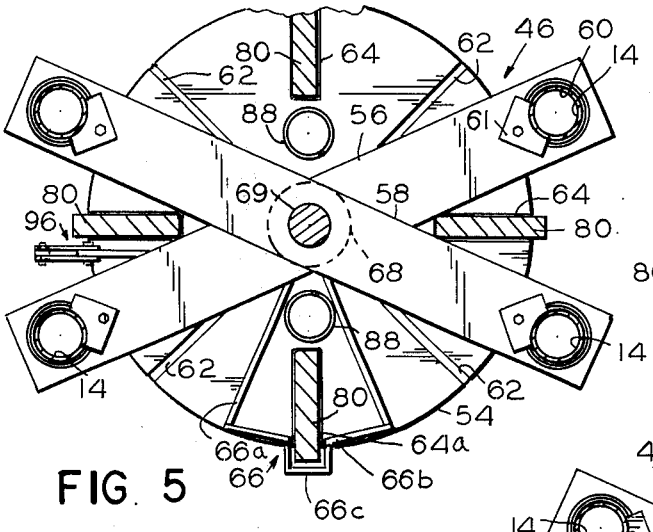
FIG. 5 is a horizontal sectional view taken along the line 5—5 of FIG. 2.

Referring particularly to FIGS. 2 and 5, press platen 46 includes a horizontal circular press platen plate 54 which is adopted for pressing engagement with the top of the stack of tires 20. Plate 54 is affixed to the bottom of tubular cross members 56, 58 which are provided with openings near their outer ends through which slide posts 14 extend. Such openings contain bushings 60 secured by bushing keepers 61 for free sliding movement of the platen along slide posts 14.

Plate 54 has radial through slots 62 which extend inwardly from its periphery and which are aligned vertically with the corresponding slots 36 of base plate 32 for guiding a baling strap or tie in encirclement of the compressed stack while the press platen plate 54 maintains pressure on the stack. Press platen plate 54 also has short radial knife slots 64 which extend inwardly of its periphery between long slots 62 in vertical alignment with short slots 38 in base plate 32. Such slots 64 permit the passage of slitting knives on the knife platen through the press platen plate in a manner to be described. The front such knife slot 64*a* is surrounded by an upstanding shield structure 66 including opposite side shield plates 66*a* and front shield plates 66*b* and 66*c* to shield the machine operator from the frontmost knife of the machine which lies within the front access opening 16 of the machine. The other knife slots 64 remain unshielded.

Press platen 46 is supported in its raised position as shown in FIG. 2 by a flange 68 at the lower end of an extension 69 of the extensible ram portion 50. Extension 69 passes freely through the press platen to enable relative movement between such extension and the press platen upon extension of the ram. Flange 68 also retracts press platen 46 from its lowermost position near the bottom of the stacking space as shown in FIG. 1 to its raised position upon retraction of the ram.

Figure 4:
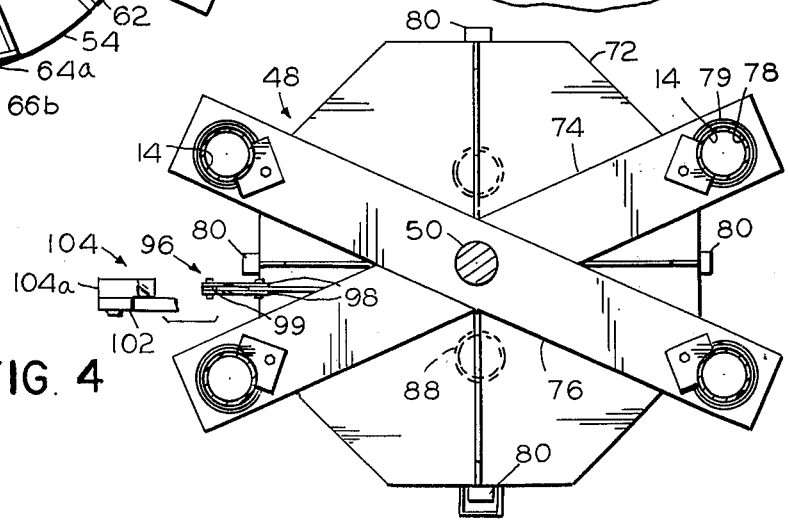
FIG. 4 is a horizontal sectional view taken along the line 4—4 of FIG. 2.

Now referring to FIGS. 2 and 4, knife platen 48 includes a lower octagonal knife platen plate 72 mounted to the bottom of tubular cross members 74, 76 similar to cross members 56, 58 of the press platen. The outer ends of the cross frame members 74, 76 also carry bushings 78 within openings 79 receiving the four slide posts 14 of the machine frame. Knife plate 72 carries four slitting knives 80 extending radially and symmetrically about plate 72. The knives are affixed to the bottom surface of plate 72 and extend downwardly toward the press platen in vertical alignment with its knife slots 64 and the corresponding knife slots 38 in base plate 32.

The knife platen is connected to extensible ram portion 50 at 50*a* for vertical movement with such ram portion. When extensible ram portion 50 is fully retracted, it supports knife platen 48 a distance above press platen 46 such that the lower cutting edges of knives 80 do not extend below the lower surface of the press platen.

As shown in FIGS. 7 and 8, the main body of each knife 80 is vertically split into two sections and has considerable thickness but tapers inwardly near its lower end which is provided with an upwardly extending recess 82 for receiving a sharpened knife blade 84. Blade 84 is made of a hardened cutting steel or other suitable material. The blade is held in place within its recess by clamp screws 86. As shown in FIG. 2, the lower ends of each knife 80 and its blade 84 angle upwardly from the radially innermost and lowermost end tip of the knife at an angle to a horizontal plane passing through such tip. Thus as the knives are forced into cutting engagement with the tire stack, the lowermost tip 84*a* of their cutting blades engage and penetrate the stack first, followed by the remaining portion of the blade to provide a shear cutting action which reduces the force required to slit through the stack and prolongs the life of the cutting blades.

A pair of compression springs 88 extend from the top of plate 54 of the press platen to the undersurface of plate 72 of the knife platen. These springs exert a force tending to maintain separation of the two platens. Thus upon downward extension of the ram, downward movement of knife platen 48 transmits a downward moving force through springs 88 to press platen 46, moving it firmly against the top of the stack before the springs start to compress. As the pressure of springs 88 is overcome, the knife platen approaches the press platen, causing knives 80 to pass downwardly through the press platen and into cutting engagement with the tire stack. FIG. 1 illustrates this "collapsed" relationship between the knife and press platens as do the phantom line positions of the knife and press platens in FIG. 2.

The machine also includes a tire stack guiding means 90 as shown in FIG. 2. Such guide means includes a hydraulic cylinder 92 installed below the support surface for machine base 10 and centrally of the tire-stacking space. Cylinder 92 includes a guide rod portion 94 extensible upwardly through base 10, base plate 32, centering spool 40 and the center opening through tire stack 20 into engagement against flange 68 of extensible ram portion 50. Upon extension of ram portion 50 downwardly, guide rod 94 of cylinder 92 is retracted downwardly until the stack is fully compressed. This feature prevents tires which are not in exact vertical alignment in the stack from being forced laterally from the stack upon compression by the press platen.

FIG. 1 shows the ram and press and knife platens in their most downwardly extended positions during maximum compression of the stack. Upon upward withdrawal of the knife and press platens from this position by the hydraulic ram, there would normally be a tendency for the compressed tires in the bale to cling to knives 80 to lift the bale. To prevent this, knife-stripping means, indicated generally at 96 in FIG. 2, is provided to strip knives 80 from the compressed bale as the knife platen is retracted. This is done by momentarily holding the press platen in its lowermost position against the bale while the knife platen moves upwardly to withdraw the knives from the stack.

Stripping means 96 includes a scissors linkage comprising an upper link 98 pivoted at one end to the knife platen and a lower link 99 pivoted at one end to the lower platen. The two links are pivoted together at 100. Upper link 98 has an extension **98*a* extending beyond pivot connection 100. Also included in the stripper mechanism is a vertical support member 102 extending upwardly from one side of base 10. A latch member 104 pivoted to the upper end of support member 102 has curved upper camming surface 104*a* and a flat, horizontal latching surface 104*b*.**

As the knife and press platens move downwardly under the influence of ram 52 toward their lower limit positions, link extension **98*a* contacts curved upper surface 104*a* of latch member 104, swinging it to one side to permit link extension 98*a* and thus the platens to pass downwardly past the latch member. After link extension 98*a* clears the latch member, the latch member swings back to its normal position with its latching surface 104*b* above link extension 98*a*. Thereafter, when the ram is retracted to return the platens to their upper limit positions, link extension 98*a* engages flat latching surface 104*b* of latch member 104, preventing upward travel of press platen 46. However, as the ram retracts, knife platen 48 attached to it moves upwardly away from the press platen, withdrawing knives 80 from the bale and gradually straightening the linkage 98–99. Eventually, when the knife platen moves upwardly a distance sufficient to retract the blades of knives 80 above the lower end of the press platen, link extension 98*a* assumes a sufficiently vertical position to enable it to clear latch member 104. Thereafter continued retraction of the ram causes press platen 46** to begin its upward travel with the knife platen, continuing until they return to their upper limit positions.

OPERATION

In operation, the press and knife platens are initially in their retracted upper limit positions as shown in FIG. 2. Guide rod 94 is fully retracted in guide cylinder 90. Tires to be compressed and baled are inserted into the machine through the front access opening 16 over centering spool 40 and stacked vertically within the machine space 18. The machine shown in FIG. 1 has a capacity of approximately ten passenger car tires. With the tires thus stacked, guide rod 94 is extended upwardly through the center openings of the tires to maintain vertical alignment of the stack. The machine is now ready to compress and slit the stack.

The operator, now at the controls 30 at the rear of the machine, operates the controls to activate ram 52 and thereby start the downward extension of ram portion 50. As ram portion 50 extends downwardly, it moves knife platen 48 downwardly also. Downward movement of knife platen 48 causes corresponding downward movement of press platen 46 until plate 54 of the press platen firmly engages the top of the stack 20. Thereafter continued downward extension of the ram causes springs 88 to compress as the upward resistance of the stack overcomes the resistance of such springs, whereby knife platen 48 approaches press platen 46. During this approach knives 80 pass through the knife slots 38 in press platen plate 54 into cutting engagement with the stack to begin their slitting action.

As the ram portion 50 continues its downward extension, plate 72 of knife platen 48 engages the top of knife shield 66 of the press platen. Thereafter the knife and press platens move downwardly together, with the press platen compressing the stack as the knife platen forces the knives through the stack, causing a simultaneous compression and slitting of the stack. Compression and slitting of the stack continues until the stack is fully compressed, at which point knives 80 have slit completely through the stack and the knife blades extend into knife slots 38 of base plate 32.

At this point the downward ram pressure is maintained to hold the stack in compression as baling wires, straps or other ties are guided through the slots 62 of the press platen plate 54, slots 41 of the centering spool 40 and down through the center of the stack and out through radial slots 36 of the base plate to encircle the compressed stack, after which the opposite ends of the ties are fastened together to secure the bale in its compressed condition.

The ram can now be retracted to withdraw the platen from the bale. Upon upward retraction of ram portion 50, the knife platen moves upwardly but the press platen 46 is held in its downward position by stripping mechanism 96 as previously described until the knives are fully withdrawn from the bale. Thereafter, upon continued upward retraction of the ram, the now spaced-apart knife and press platens move upwardly together to their upper limit positions as shown in FIG. 2.

As the press platen moves upwardly, the operator connects the hook 43 of the lift chain 42 to the press platen. The length of the chain is such that as the press platen moves upwardly, the chain slack is taken up. Thereafter further upward movement of the platen lifts the connected edge of base plate 32 to tilt it about the axis of hinge 34, dumping the bale out through access opening 16 from the machine onto the floor where it can be removed by conventional materials handling equipment, such as a fork lift truck. The chain is then slackened and unhooked from the press platen by momentarily lowering the ram, after which the ram is retracted fully to return the platens to their upper positions ready for the next baling cycle.

Having illustrated and described what is presently a preferred form of the invention, it will be apparent to persons skilled in the art that the machine can be modified in arrangement and detail. It is our intention to claim as our invention all such modifications and equivalents as come within the true spirit and scope of the following claims.

We claim:

1. A machine for compressing, slitting and baling a stack of rubber tires comprising:

first vertically movable platen means supportable in an upper limit position above a stack of tires to be compressed, second vertically movable platen means supportable in an upper limit position spaced above said first platen means, knife means projecting downwardly from said second platen means towards vertically aligned openings in said first platen means permitting passage of said knife means below said first platen means upon downward movement of said second platen means relative to said first platen means, pressure-applying means for moving said second platen means downwardly towards said first platen means such that said second platen means applies a downward moving force to said first platen means and approaches said first platen means to project said knife means below said first platen means whereby said stack is simultaneously slit and compressed as said first and second platen means move downwardly against said stack.

2. A machine according to claim 1 including a stationary base plate in vertical alignment with said first and second platen means for supporting a stack of tires to be processed, a tire-centering spool projecting upwardly centrally of said base plate, and cooperative guide passage means on said spool, first platen means and base plate enabling encirclement of said stack when compressed by baling tie means.

3. A machine according to claim 1 wherein said pressure-applying means comprises a vertically extending fluid-powered ram having an extensible ram portion with means engaging said second platen means for downward movement thereof and with means engaging said first platen means for upward movement thereof.

4. A machine according to claim 1 including compression spring means between said first and second platen means for transmitting a limited downward moving force from said second platen means to said first platen means upon initial downward movement of said second platen means but causing collapse of said second platen means towards said first platen means upon engagement of said first platen means with said stack.

5. A machine according to claim 1 wherein said pressure-applying means is operable to return said first and second platen means to their respective said upper limit positions, and stripping means operable to maintain said first platen means in its lowermost position compressing a stack momentarily while said second platen means begins its return movement toward its upper limit position to enable withdrawal of said knife means from the compressed stack.

6. A machine for compressing, baling and slitting a stack of rubber tires comprising:

an open upstanding frame structure defining a central vertically extending space within said structure for receiving a stack of tires to be processed, a press platen means extending across said space and supported in a raised position above said stack, said press platen means being mounted for vertical sliding movement on said frame structure, a knife platen means extending across said space above said press platen means and being mounted for vertical sliding movement on said frame structure independent of said press platen means, pressure-applying means connected to said knife platen means and operable to move said knife platen means vertically within said space between an upper limit position spaced above said raised position of said press platen means and a lower limit position near a lower end of said space, knife means carried by said knife platen means for slitting said stack, said knife means projecting downwardly toward said press platen means, said knife means being aligned vertically with openings through said press platen means to enable said knife means to pass through said press platen means upon downward movement of said knife platen means for its upper limit position such that upon operation of said pressure-applying means to move said knife platen means downwardly said knife platen means forces said press platen means downwardly against said stack and said knife means projects downwardly past said press platen means into cutting engagement with said stack whereafter continued downward movement of said knife and press platen means together effect simultaneous compression and slitting of said stack.

7. A machine according to claim 6 including resilient compression means extending between said press platen means and said knife platen means to exert a separating force therebetween so that initial downward movement of said knife platen means from its upper limit position causes a corresponding downward movement of said press platen means into engagement with said stack before said knife means passes through said press platen means to engage said stack for slitting.

8. A machine according to claim 6 wherein said pressure-applying means comprises a hydraulic ram means including an extensible ram portion operatively connected to said knife platen means and with means engageable with a bottom portion of said press platen means for returning said press platen means to its raised position and supporting it in said raised portion.

9. A machine according to claim 6 including a stack-centering guide means movable centrally within said space from a retracted position below the lower limits of said space to an extended position near the level of said press platen means when in its said raised position, said guide means being movable progressively downwardly from its said extended position to its said retracted position upon progressive downward compressing movement of said press platen means against said stack.

10. A machine according to claim 6 wherein said open frame structure includes spaced vertical slide posts extending between a stationary base and a stationary top frame structure, said knife and press platen means being slidably mounted on said slide posts.

11. A machine according to claim 1 wherein said vertically aligned openings in said first platen means comprise radial slots extending therethrough and said knife means includes multiple slitting knives spaced about peripheral portions of said second platen means and aligned vertically with corresponding said radial slots in said first platen means enabling said knives to pass through said first platen means.

12. A machine according to claim 1 wherein said knife means includes a slitting knife fixed to said second platen means, said knife having a bottom cutting edge extending at an angle upwardly from a horizontal plane passing through one end tip of said edge.

13. A machine according to claim 6 including a stationary base plate for supporting said stack within said frame space, said knife means including multiple knives fixed in spaced-apart positions to peripheral portions of said knife platen means in vertical alignment with corresponding clearance slots in said press platen means and said base plate enabling cutting portions of said knives to pass through said press platen means and below the upper surface of said base plate to slit through the vertical length of a stack supported on said base plate.

14. A machine for compressing, slitting and baling a stack of rubber tires comprising:

first vertically movable platen means supportable in an upper limit position above a stack of tires to be compressed, second vertically movable platen means supportable in an upper limit position spaced above said first platen means, knife means projecting downwardly from said second platen means towards vertically aligned openings in said first platen means permitting passage of said knife means below said first platen means upon downward movement of said second platen means relative to said first platen means, pressure-applying means for moving said second platen means downwardly towards said first platen means such that said second platen means applies a downward moving force to said first platen means and approaches said first platen means to project said knife means below said first platen means whereby said stack is simultaneously slit and compressed as said first and second platen means move downwardly against said stack, a stationary base plate in vertical alignment with said first and second platen means for supporting a stack of tires to be processed, a tire-centering spool projecting upwardly centrally of said base plate, and cooperative guide passage means on said spool, first platen means and base plate enabling encirclement of said stack when compressed by baling tie means, said pressure-applying means comprising a vertically extending fluid-powered ram having an extensible ram portion with means engaging said second platen means for downward movement thereof and with means engaging said first platen means for upward movement thereof, compression spring means between said first and second platen means for transmitting a limited downward moving force from said second platen means to said first platen means upon initial downward movement of said second platen means but causing collapse of said second platen means towards said first platen means upon engagement of said first platen means with said stack, said pressure-applying means being operable to return said first and second platen means to their respective said upper limit positions, and stripping means operable to maintain said first platen means in its lowermost position compressing a stack momentarily while said second platen means begins its return movement toward its upper limit position to enable withdrawal of said knife means from the compressed stack.

15. A machine according to claim 14 including a stack-centering guide means movable centrally through the stack within a space below said first platen for receiving the stack from a retracted position below the lower limits of said space to an extended position near the level of said first platen means when in its upper limit position, said guide means being movable progressively downwardly from its said extended position to its said retracted position upon progressive downward compressing movement of said first platen means against said stack.

* * * * *